US008839630B2

(12) United States Patent
Nepsha et al.

(10) Patent No.: US 8,839,630 B2
(45) Date of Patent: Sep. 23, 2014

(54) THERMOELECTRIC DEHUMIDIFIER AND ENCLOSURE VENT DRAIN ASSEMBLY

(75) Inventors: William J. Nepsha, Elk River, MN (US); Bruce W. Larson, Andover, MN (US); Gregory A. Quick, Maple Grove, MN (US); Robert M. Kalstabakken, Cambridge, MN (US)

(73) Assignee: Hoffman Enclosures, Inc., Anoka, MN (US)

( * ) Notice: Subject to any disclaimer, the term of this patent is extended or adjusted under 35 U.S.C. 154(b) by 1023 days.

(21) Appl. No.: 12/581,734

(22) Filed: Oct. 19, 2009

(65) Prior Publication Data

US 2010/0154437 A1 Jun. 24, 2010

Related U.S. Application Data

(60) Provisional application No. 61/106,430, filed on Oct. 17, 2008, provisional application No. 61/106,386, filed on Oct. 17, 2008.

(51) Int. Cl.
*F25B 21/02* (2006.01)
*F16K 31/18* (2006.01)

(52) U.S. Cl.
USPC ..... 62/3.4; 137/433

(58) Field of Classification Search
USPC ..... 62/3.4, 272, 285, 288, 289, 290, 291; 236/53, 61; 137/433, 588
See application file for complete search history.

(56) References Cited

U.S. PATENT DOCUMENTS

| | | | | |
|---|---|---|---|---|
| 2,146,311 | A | | 2/1939 | Pittman et al. |
| 3,071,148 | A | | 1/1963 | Woodmansee |
| 3,356,255 | A | | 12/1967 | Zavertnik et al. |
| 3,580,267 | A | | 5/1971 | Baker |
| 3,610,275 | A | | 10/1971 | Determan |
| 3,799,186 | A | | 3/1974 | Bulin |
| 4,586,342 | A | * | 5/1986 | Morishita et al. ..... 62/3.4 |
| 4,627,460 | A | * | 12/1986 | Eising ..... 137/192 |
| 4,836,478 | A | | 6/1989 | Sweere |
| 5,121,767 | A | | 6/1992 | Chuang |
| 5,123,627 | A | | 6/1992 | Hodges |
| 5,661,265 | A | | 8/1997 | Yarbrough et al. |
| 5,703,325 | A | | 12/1997 | Yamaguchi et al. |
| 5,738,316 | A | | 4/1998 | Sweere et al. |
| 5,743,503 | A | | 4/1998 | Voeller et al. |
| 5,797,426 | A | | 8/1998 | Powell |
| 5,842,672 | A | | 12/1998 | Sweere et al. |
| 5,876,008 | A | | 3/1999 | Sweere et al. |
| 5,947,429 | A | | 9/1999 | Sweere et al. |
| 5,967,479 | A | | 10/1999 | Sweere et al. |
| 5,992,809 | A | | 11/1999 | Sweere et al. |

(Continued)

FOREIGN PATENT DOCUMENTS

| | | | |
|---|---|---|---|
| JP | 6077669 | A | 3/1994 |
| JP | 2003229680 | | 8/2003 |
| JP | 2005109107 | A | 4/2005 |

*Primary Examiner* — John F Pettitt
*Assistant Examiner* — Ignacio E Landeros
(74) *Attorney, Agent, or Firm* — Quarles & Brady LLP

(57) ABSTRACT

Embodiments of the invention provide a dehumidifier and a vent drain assembly to reduce moisture in an electrical enclosure. The dehumidifier can include a thermoelectric module, a drain pan, and a fitting to release the collected moisture from the drain pan. The vent drain assembly can receive the collected moisture from the drain pan and the fitting. The vent drain assembly can include a valve body, a float, and a cap.

18 Claims, 23 Drawing Sheets

(56) References Cited

U.S. PATENT DOCUMENTS

| | | | | |
|---|---|---|---|---|
| 6,012,693 | A | 1/2000 | Voeller et al. | |
| 6,015,120 | A | 1/2000 | Sweere et al. | |
| 6,019,332 | A | 2/2000 | Sweere et al. | |
| 6,034,317 | A | 3/2000 | Watanabe et al. | |
| 6,075,206 | A | 6/2000 | Walker | |
| 6,085,769 | A | 7/2000 | Poyner et al. | |
| 6,147,298 | A | 11/2000 | Mina et al. | |
| 6,250,083 | B1 * | 6/2001 | Chou | 62/3.4 |
| 6,258,269 | B1 * | 7/2001 | Knight | 210/248 |
| 6,318,403 | B1 | 11/2001 | Fritz | |
| 6,490,874 | B2 | 12/2002 | Chu et al. | |
| 6,513,342 | B1 | 2/2003 | Flynn | |
| 6,564,820 | B2 | 5/2003 | Christman | |
| 6,698,225 | B2 | 3/2004 | Chaves | |
| 6,904,933 | B2 | 6/2005 | Oyamada | |
| 7,174,739 | B2 | 2/2007 | Ozaki | |
| 7,252,277 | B2 | 8/2007 | Sweere et al. | |
| 7,265,966 | B2 | 9/2007 | Dudley | |
| 2004/0060106 | A1 * | 4/2004 | Mistarz | 4/507 |
| 2007/0000564 | A1 | 1/2007 | Jones | |
| 2007/0137706 | A1 | 6/2007 | Stamatakis et al. | |

* cited by examiner

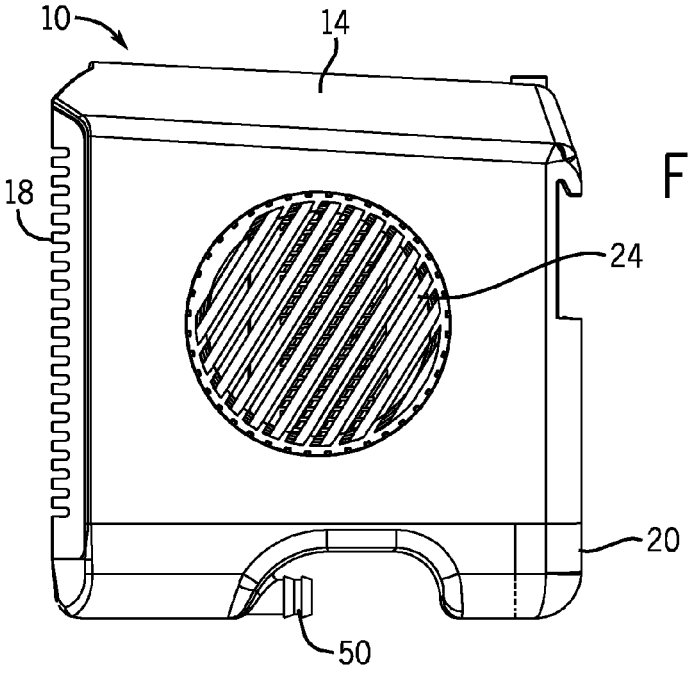
FIG. 9
FIG. 10
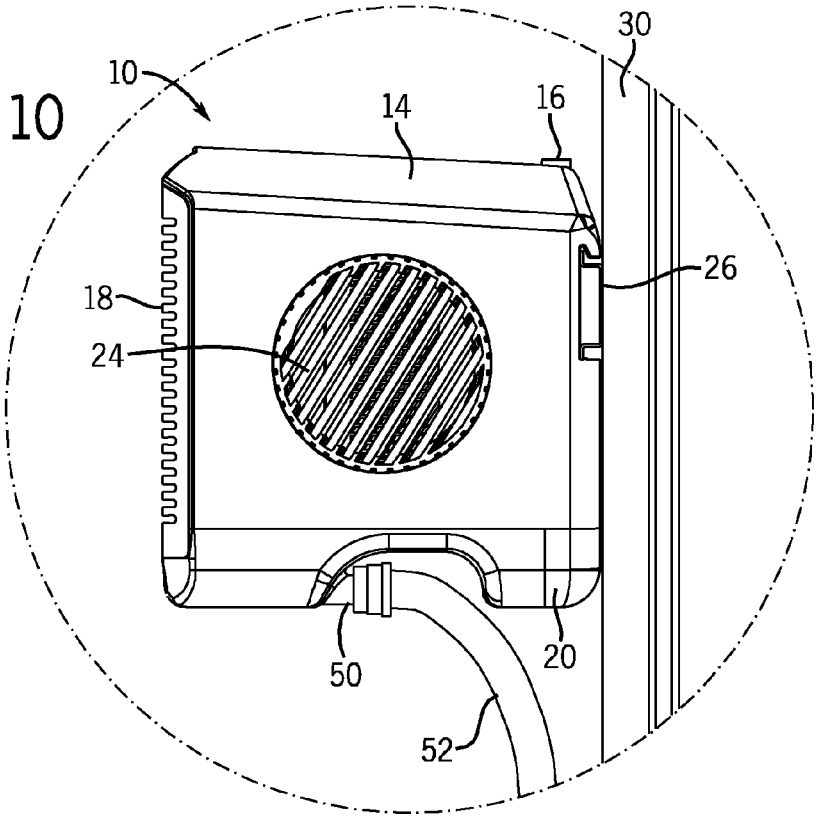

THERMOELECTRIC DEHUMIDIFIER AND ENCLOSURE VENT DRAIN ASSEMBLY

RELATED APPLICATIONS

This application claims priority under 35 U.S.C. §119 to U.S. Provisional Patent Application Nos. 61/106,430 and 61/106,386, both filed on Oct. 17, 2008, the entire contents of which are incorporated herein by reference.

BACKGROUND

Electrical enclosures often require moisture control to help reduce corrosion and help prevent electrical components housed within them from failing. Dehumidifiers using thermoelectric (TE) modules have been used as compact, low-cost, quiet devices for achieving moisture control. Most electrical components or computer interfaces housed within the electrical enclosures use a 24-volt power source. Mains voltages to the electrical enclosure may vary depending on the country or region (e.g., 120 volts, 240 volts, etc.). Electrical enclosures often include some type of voltage transformation and regulation to produce a 24-volt supply from the mains supply. Most conventional dehumidifiers operate using 12 volts. As a result, the 24-volt supply must be converted to 12 volts.

Electrical enclosures also often include drains to remove moisture that may accumulate in a bottom portion of the enclosure. The drains, however, do not allow any water or moisture to enter the enclosures as this may damage the electrical components. Various conventional drain assemblies use float devices to drain excess moisture from the enclosure and to help prevent outside moisture from entering the enclosure. However, during wash-down periods, temperature differences between the outside and inside of the enclosure can cause a decrease in pressure within the enclosure. With conventional drain assemblies, the pressure decrease creates a vacuum which can keep the float devices in a position that restricts water in the enclosure from draining. These temperature-induced vacuums can only be relieved by opening the door of the enclosure.

SUMMARY

Some embodiments of the invention provide a system to reduce moisture in an electrical enclosure including an aperture. The system can include a dehumidifier positioned in the electrical enclosure. The dehumidifier can include a thermoelectric module, a drain pan to collect moisture from the thermoelectric module, and a fitting to release the collected moisture from the drain pan. The system can also include a vent drain assembly positioned in the aperture to receive the collected moisture from the drain pan and the fitting. The vent drain assembly can include a valve body, a float, and a cap. The float can be movable between a first position abutting the valve body to prevent moisture from entering the electrical enclosure and a second position abutting the cap to allow moisture to exit the electrical enclosure. The float can include a center pathway that allows only air into the electrical enclosure when the float is in the first position and the second position.

Embodiments of the invention provide a dehumidifier for use in an electrical enclosure with a 24-volt power source. The dehumidifier can include a thermoelectric module with two 12-volt thermoelectric chips electrically connected in series and powered by the 24-volt power source. The thermoelectric module can also include a cold side with condensing fins and a hot side with a heat sink and a fan. The dehumidifier can further include a curved drain pan positioned under the condensing fins, circular side vents positioned on either side of the thermoelectric module, and rotatable baffles positioned over the circular side vents.

DESCRIPTION OF THE DRAWINGS

FIG. 9 is a side view of the TE dehumidifier of FIG. 1A.

FIG. 10 is another side view of the TE dehumidifier of FIG. 1A attached to a wall of the electrical enclosure.

DETAILED DESCRIPTION

Figure 1A:
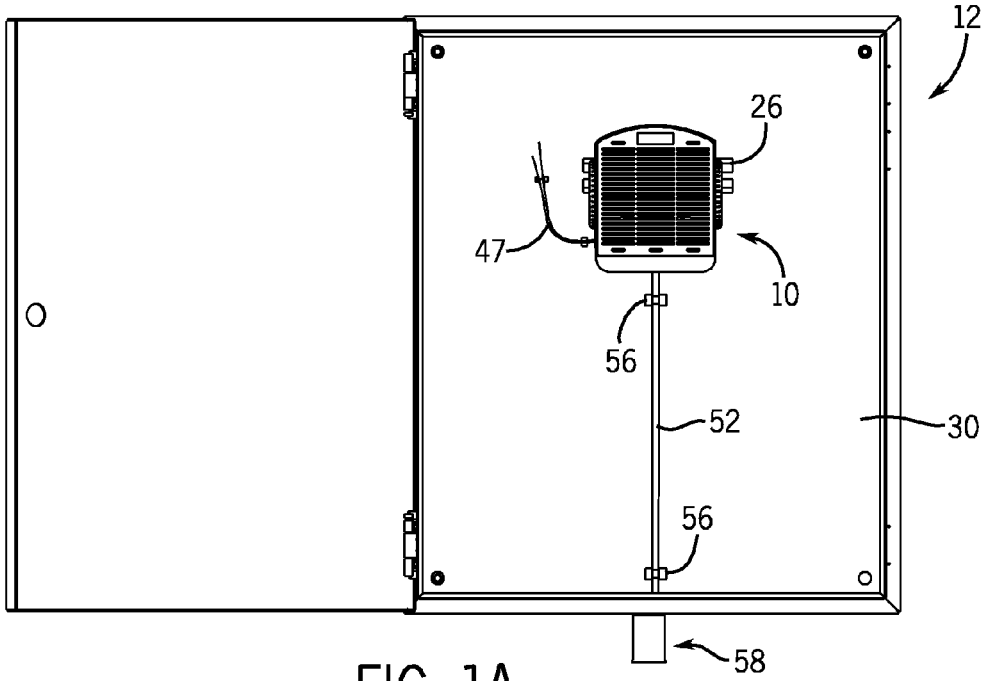
FIG. 1A is a front view of a thermoelectric (TE) dehumidifier, according to one embodiment of the invention, positioned inside an electrical enclosure.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 1B:
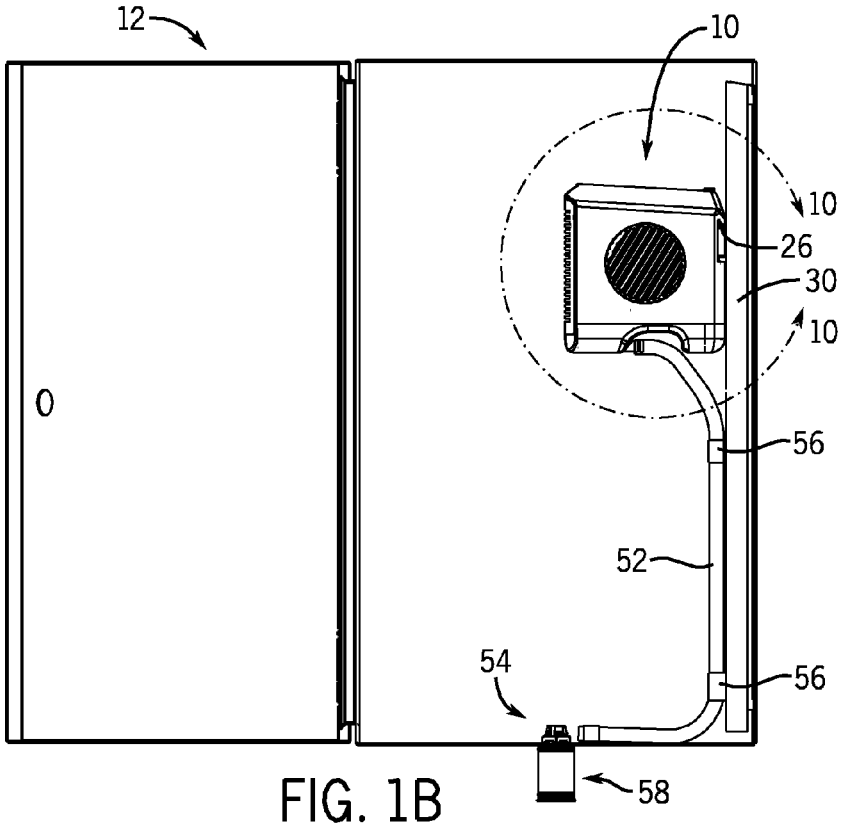
FIG. 1B is a side view of the TE dehumidifier and electrical enclosure of FIG. 1A.

FIGS. 1A-1B illustrate a thermoelectric (TE) dehumidifier 10 according to one embodiment of the invention. The TE dehumidifier 10 can be positioned in an electrical enclosure 12 and can be used for moisture control within the electrical enclosure 12. In some embodiments, the electrical enclosure 12 can be a NEMA type 4 or type 4X enclosure. The electrical enclosure 12 can be made of mild steel, aluminum, stainless steel, a non-metallic material, or other suitable materials.

Figure 2:
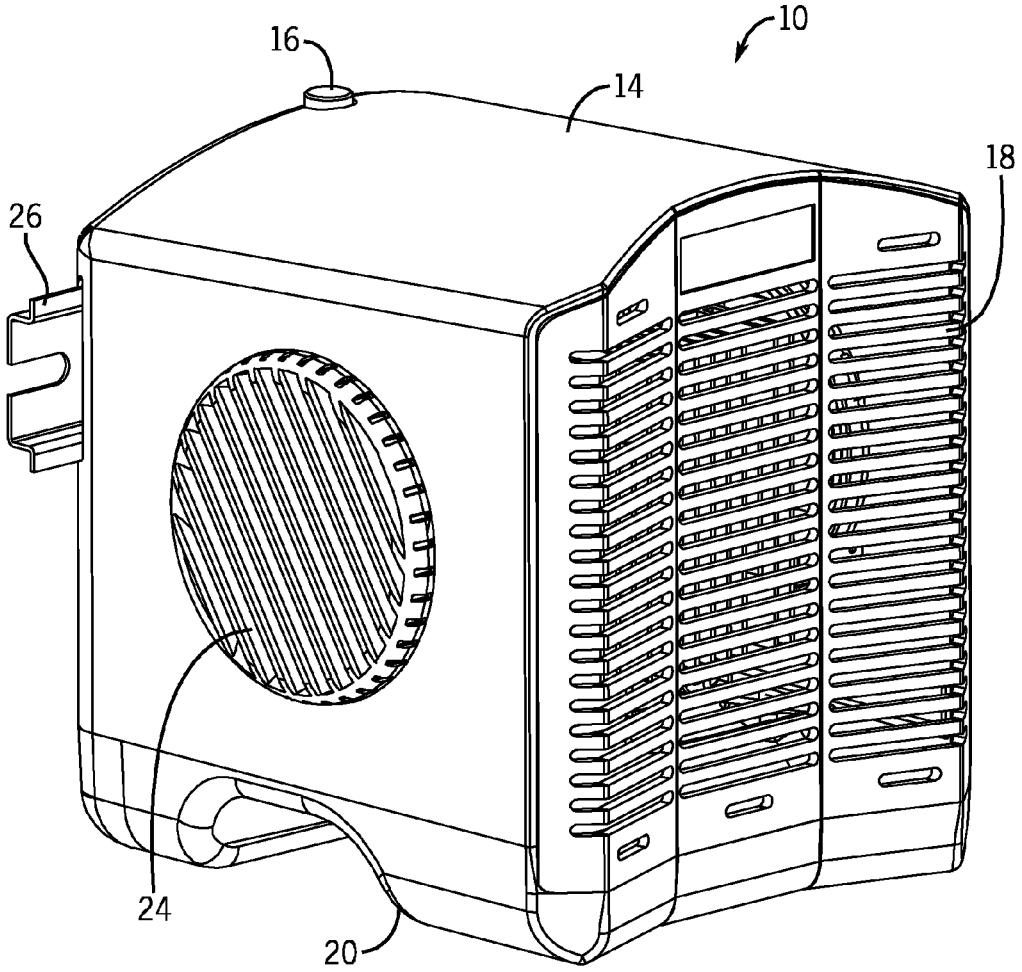
FIG. 2 is a perspective view of the TE dehumidifier of FIG. 1A.
Figure 3:
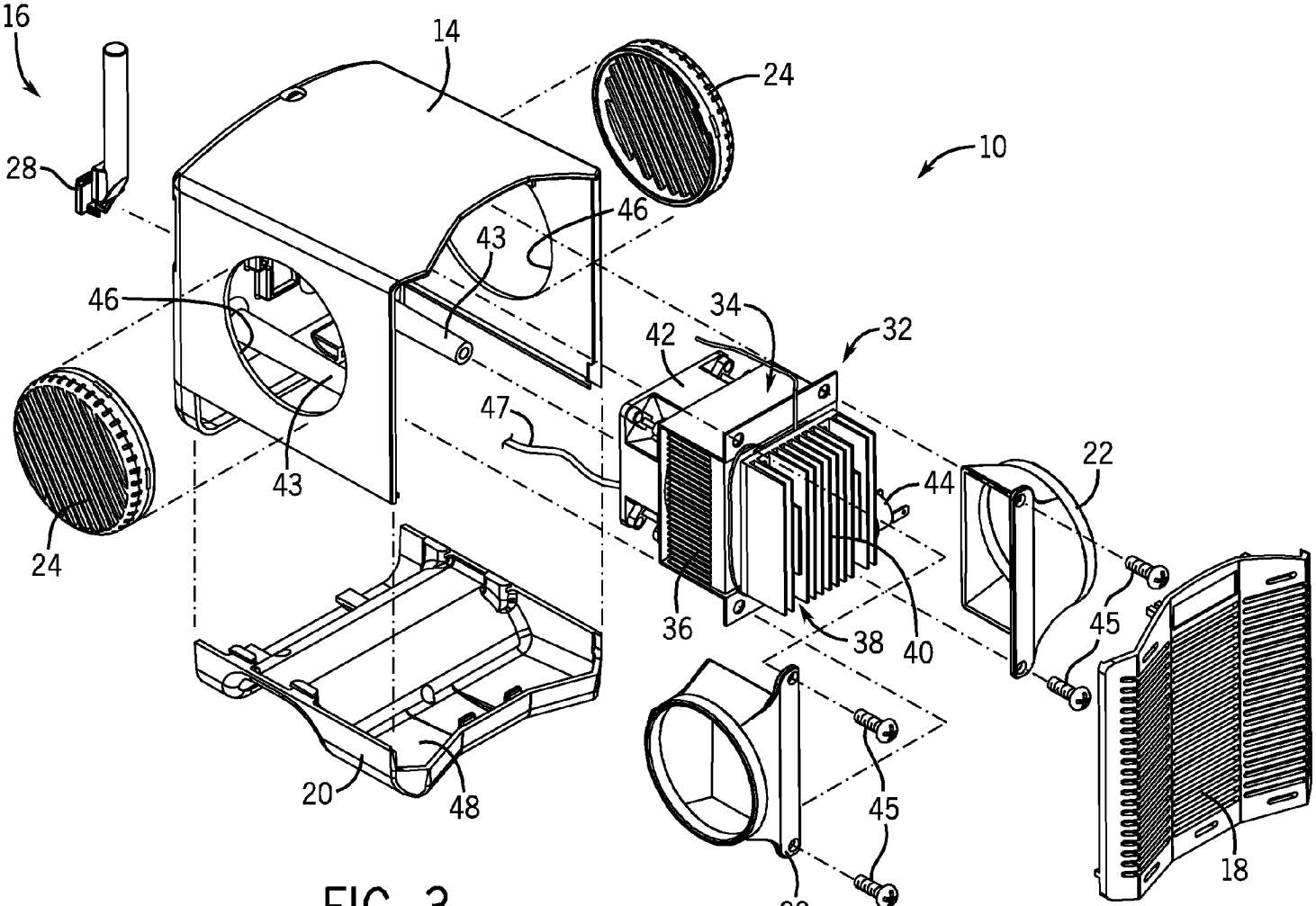
FIG. 3 is an exploded perspective view of the TE dehumidifier of FIG. 1A.
Figure 4A:
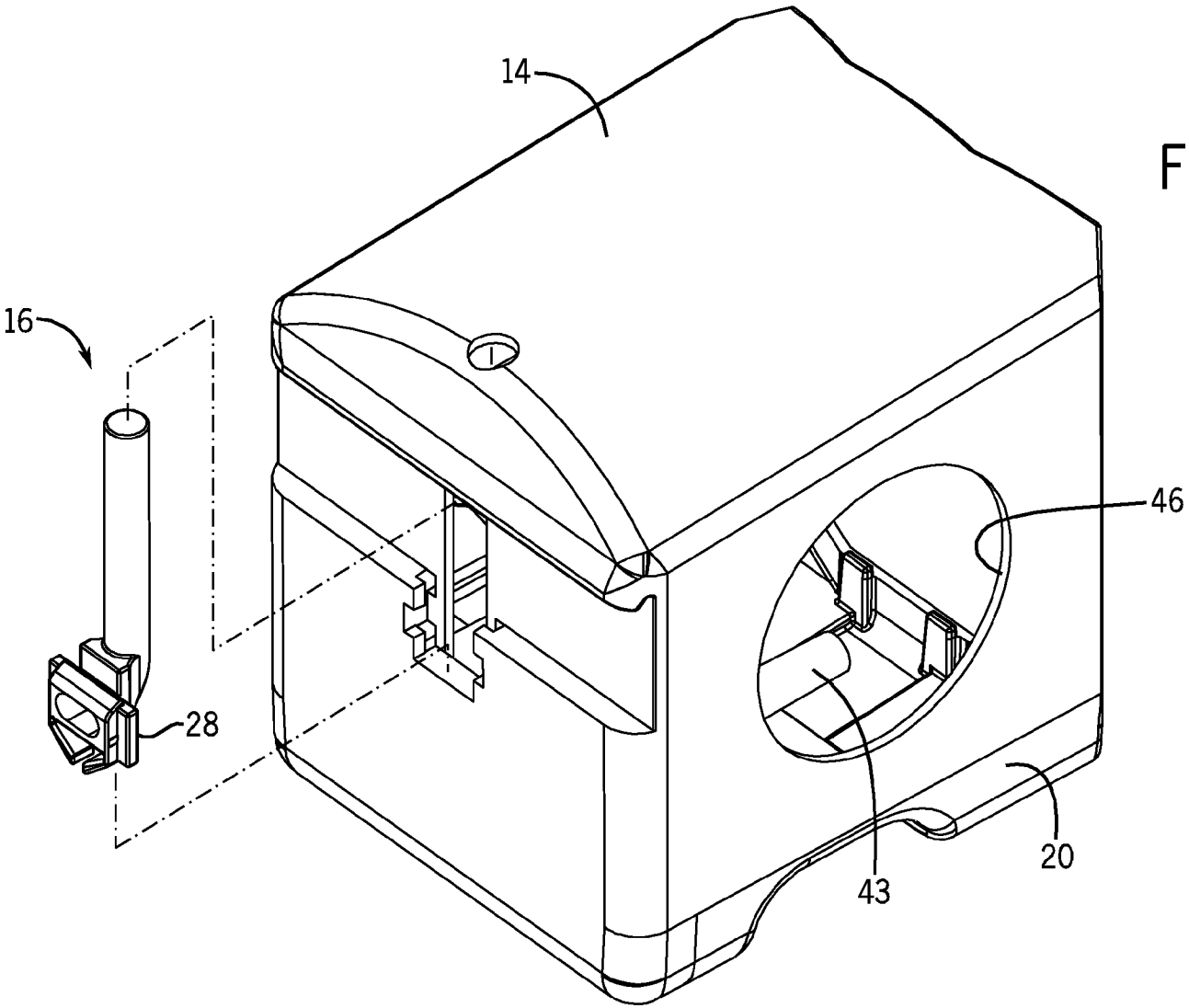
FIG. 4A is a back perspective view of the TE dehumidifier of FIG. 1A including mounting hardware.
Figure 4B:
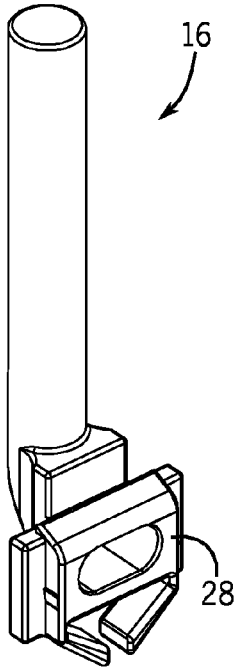
FIGS. 4B-4D are perspective views and a back view of the mounting hardware of FIG. 4A.
Figure 4C:
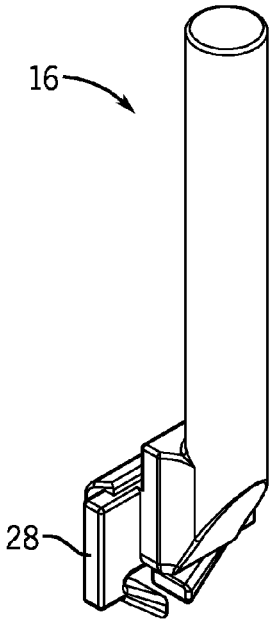
Figure 4D:
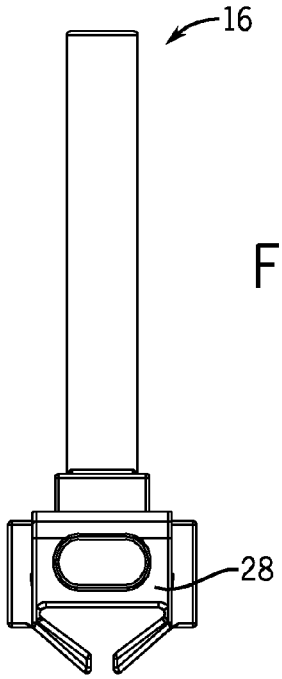

As shown in FIGS. 2-3, the TE dehumidifier 10 can include a top housing 14, mounting hardware 16, a front cover 18, a bottom housing 20, side vents 22, and baffles 24. The top housing 14, the front cover 18, the bottom housing 20, and/or the side vents 22 can be made of a rigid polymeric material, such as acrylonitrile butadiene styrene (ABS), or other suitable plastic materials.

Figure 5:
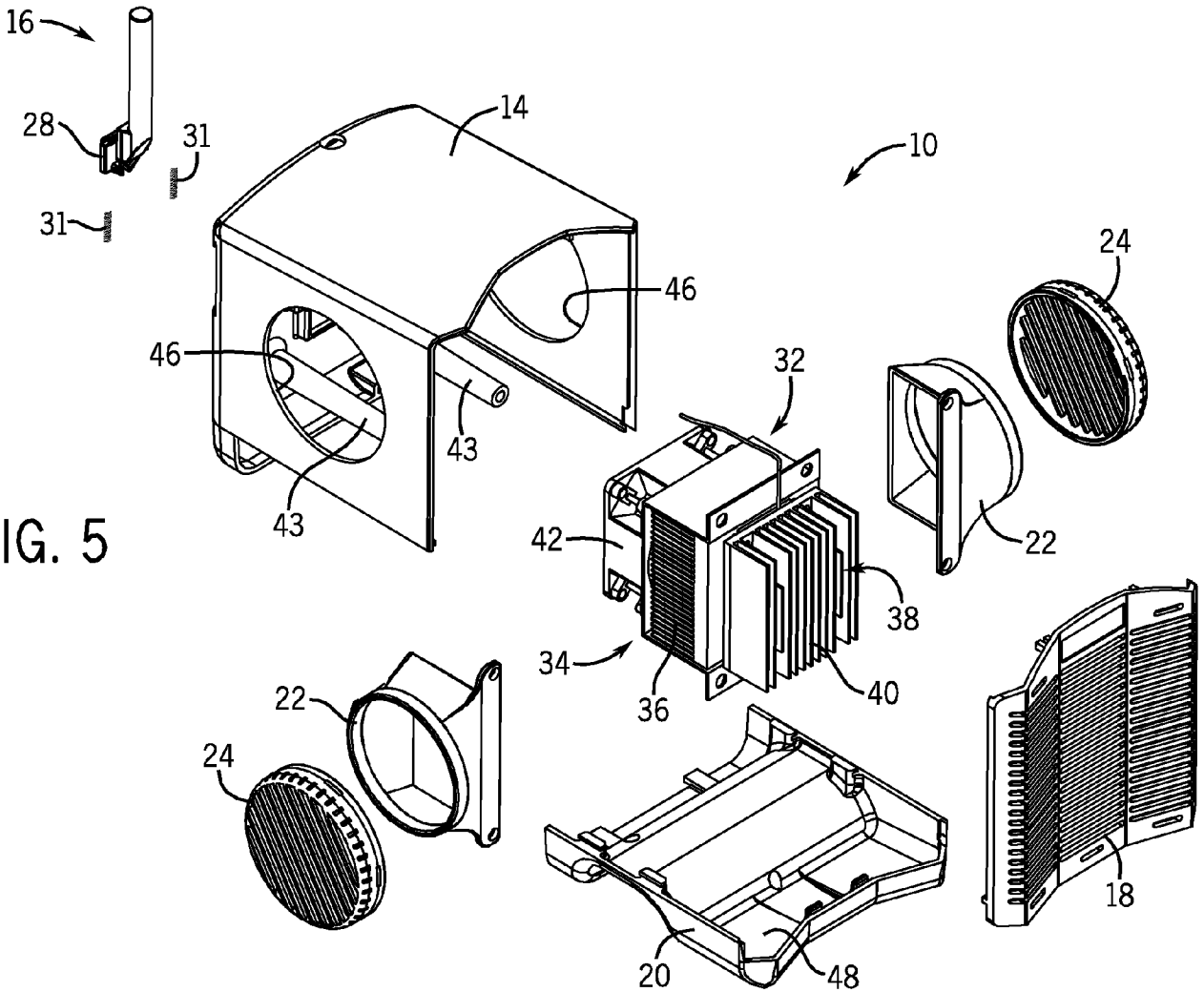
FIG. 5 is another exploded perspective view of the TE dehumidifier of FIG. 1A.

In some embodiments, the TE dehumidifier 10 can have dimensions of about 6 inches long by about 5.5 inches wide by about 5.75 inches tall. The compact dimensions can allow for a variety of mounting positions within electrical enclosures 12 of various sizes. In some embodiments, the TE dehumidifier 10 can be coupled to the electrical enclosure 12 by the mounting hardware 16 and an accompanying rail 26 (as shown in FIG. 2). For example, the rail 26 can be a DIN rail and the mounting hardware 16 can include a DIN clip 28 (as shown in FIGS. 4A-4D) which can snap onto the rail 26. The rail 26 can be coupled directly to the electrical enclosure 12 or to an internal panel 30 of the electrical enclosure 12, as shown in FIGS. 1A-1B. In addition, in some embodiments, as shown in FIG. 5, the mounting hardware 16 can also include one or more springs 31.

Figure 6:
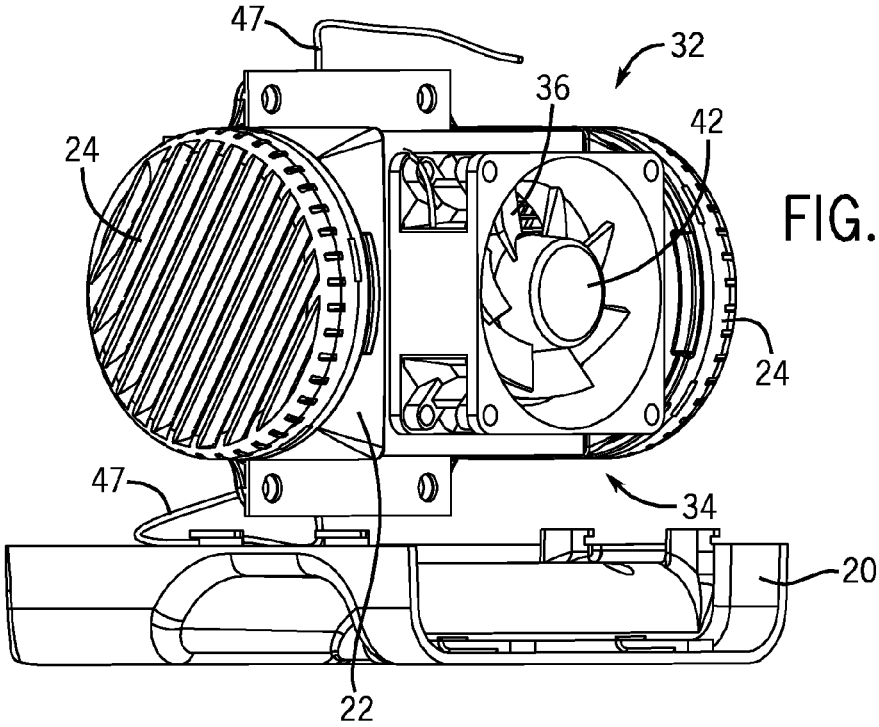
FIG. 6 is a rear perspective view of an internal portion of the TE dehumidifier of FIG. 1A.
Figure 7:
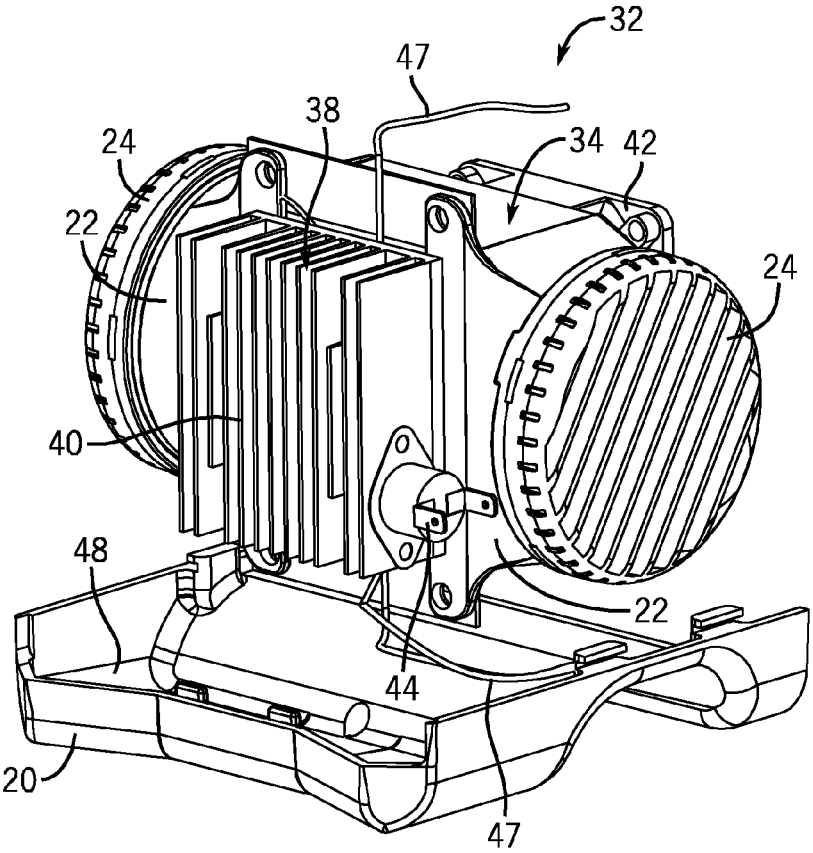
FIG. 7 is a front perspective view of the internal portion of the TE dehumidifier of FIG. 6.
Figure 8:
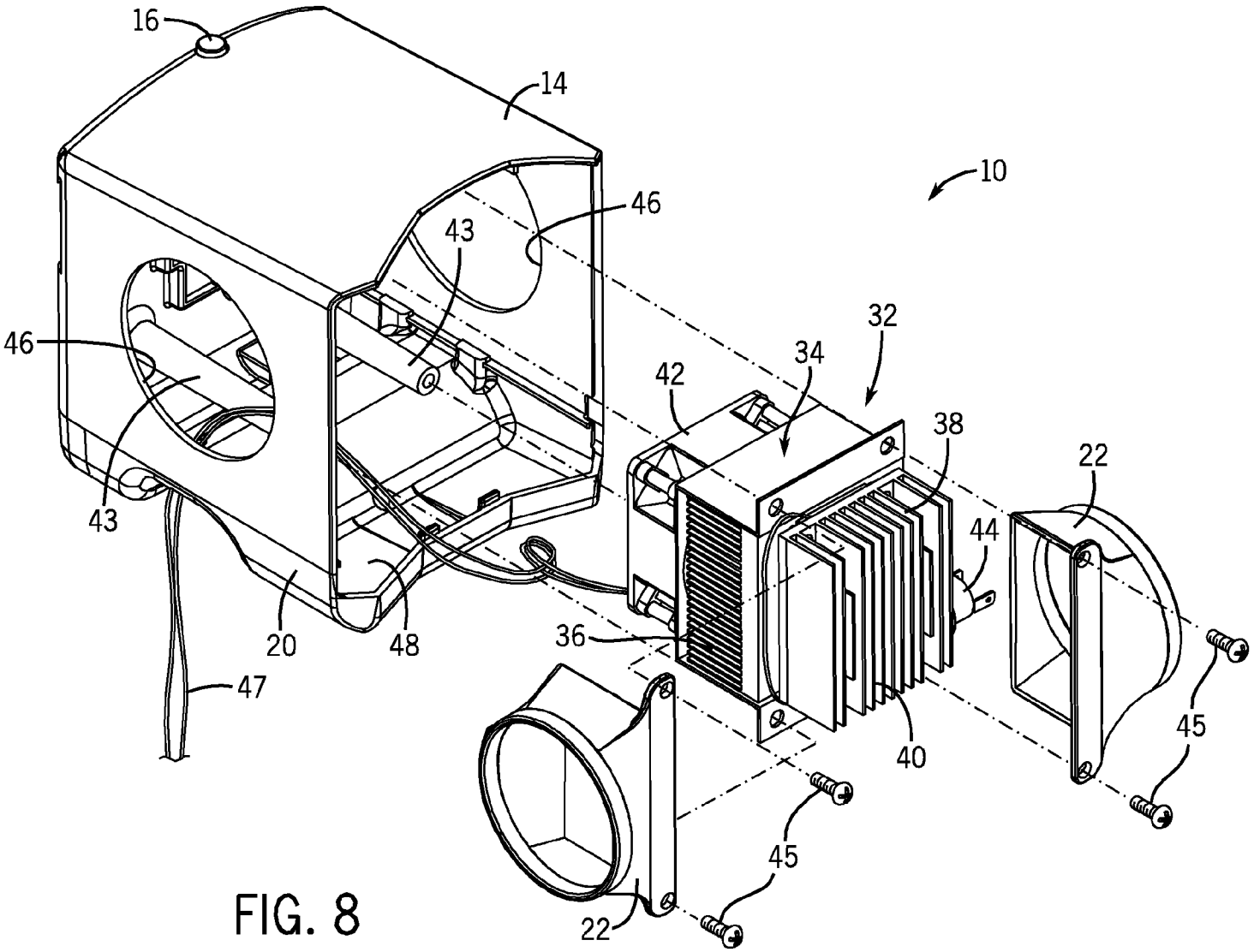
FIG. 8 is another exploded perspective view of the TE dehumidifier of FIG. 1A.

As shown in FIGS. 3, 6, and 7, the TE dehumidifier 10 can include a thermoelectric (TE) module 32. The TE module 32 can include two 12-volt TE chips connected in series. The TE module 32 can include a hot side 34 coupled to a heat sink 36, a cold side 38 coupled to condensing fins 40, a fan 42 (as shown in FIG. 6), and a bimetal thermal switch 44 (as shown in FIG. 7). The TE module 32 can be enclosed by the top housing 14, the front cover 18, and the bottom housing 20. In some embodiments, the top housing 14, the front cover 18, and the bottom housing 20 can be coupled together around the TE module 32 using a suitable adhesive. As shown in FIG. 3, the side vents 22 can be positioned through openings 46 in the sides of the top housing 14. The baffles 24 can be placed over the side vents 22 in order to selectively direct air flow toward or away from critical electronic components. The baffles 24 can also be repositioned appropriately to accommodate different mounting positions within the electrical enclosure 12. In some embodiments, the baffles 24 can be rotated up to about 270 degrees. In addition, as shown in FIGS. 3 and 8, the TE module 32 and the side vents 22 can be coupled to cylindrical protrusions 43 of the top housing 14 via screws 45.

In one embodiment, the TE dehumidifier 10, operating with the two 12-volt TE chips, can be powered by a 24-volt, direct current (DC) power supply, and draw a maximum current of about 4.5 amperes. As a result, the TE dehumidifier 10 can be powered by the same power supply as typical electrical components within the electrical enclosure 12 without the need for an additional converter. As shown in FIGS. 1A and 6-8, the TE dehumidifier 10 can include wiring 47 to connect the TE dehumidifier 10 to the 24-volt power supply (not shown). The wiring 47 can be routed through a hole (not shown) in the bottom housing 20 of the TE dehumidifier 10.

FIG. 6 illustrates a back view of the TE module 32 mounted on the bottom housing 20. The fan 42 can be positioned near the heat sink 36. Referring to FIGS. 5 and 6, the fan 42 can pull air through the front cover 18, over and under the TE module 32, across the heat sink 36, and out through the side vents 22. This positioning of the fan 42 can permit stagnant air on the cold side 38 of the TE module 32 but can move air across the hot side 34 to dissipate heat.

FIG. 7 illustrates a front view of the TE module 32 mounted on the bottom housing 20. Moisture within the air on the cold side 38 can condense on the condensing fins 40. The moisture can drip down the condensing fins 40 into a drain pan 48 formed in the bottom housing 20. In one embodiment, the TE dehumidifier 10 can be capable of removing about 8 ounces of moisture in about 24 hours. By removing moisture, the TE dehumidifier 10 can help protect electrical components in the electrical enclosure 12 from condensation and reduce corrosion in order to help increase the life of the electrical components.

As shown in FIG. 7, the bimetal switch 44 can be coupled to the condensing fins 40. The bimetal switch 44 can allow the TE dehumidifier 10 to operate substantially continuously when above freezing temperatures. For example, the bimetal switch 44 can be closed during normal operation of the TE module 32, and can be opened if the temperature of the condensing fins 40 drops to or below freezing (for example, at about 30 degrees Fahrenheit plus or minus about 5 degrees) in order to turn off the TE dehumidifier 10. This can help prevent freezing of the cold side 38 and possible failure of the TE dehumidifier 10. The bimetal switch 44 can close again once the temperature of the condensing fins 40 reaches a suitable temperature (for example, about 40 degrees Fahrenheit plus or minus about 6 degrees) allowing normal operation to continue. In some embodiments, a mechanical hygrostat (not shown) can be connected to the TE dehumidifier 10 to control the operation of the TE dehumidifier 10 based on a sensed relative humidity in the electrical enclosure 12.

Figure 11:
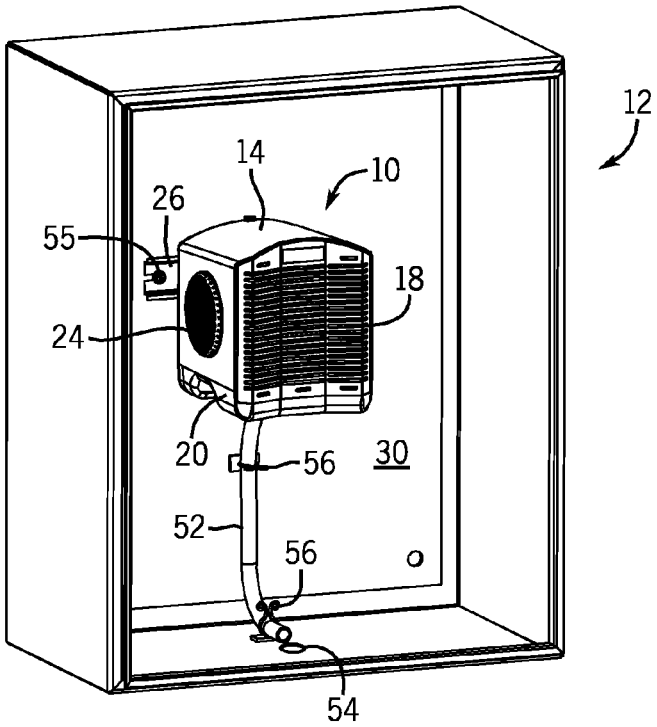
FIG. 11 is a perspective view of the TE dehumidifier of FIG. 1A positioned in the electrical enclosure according to one embodiment of the invention.

FIGS. 9 and 10 illustrate, side views of the TE dehumidifier 10. As shown in FIG. 9, the bottom housing 20 can include a fitting 50. The drain pan 48 (as shown in FIG. 8) can be curved so that moisture from the condensing fins 40 can flow from a higher portion to a lower portion where it can collect near the fitting 50. As shown in FIG. 10, the fitting 50 can be coupled to a drain hose 52, allowing moisture from the drain pan 48 to exit the TE dehumidifier 10 through the drain hose 52. As shown in FIG. 11, the drain hose 52 can lead to an aperture 54 in the enclosure 12. In one embodiment, the drain hose 52 can be a plastic hose up to about 4 feet long. Moisture within the electrical enclosure 12 can be collected inside the drain pan 48 via operation of the TE dehumidifier 10, the water can pool at the bottom of the electrical enclosure 12 via the drain hose 52, and the water can exit the electrical enclosure 12 via the aperture 54. In one embodiment, the aperture 54 can be a ⅞-inch hole in the bottom wall of the electrical enclosure 12.

Figure 12:
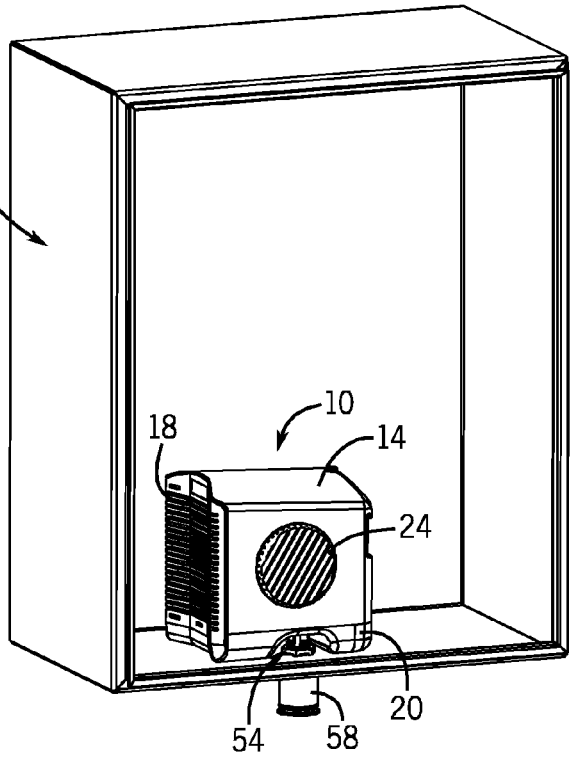
FIG. 12 is a perspective view of the TE dehumidifier of FIG. 1A positioned in the electrical enclosure according to another embodiment of the invention.

FIG. 11 illustrates the TE dehumidifier 10 coupled to the DIN mounting rail 26, which is coupled to the internal panel 30 via screws 55. As shown in FIG. 11, hose clips 56 can be used to also couple the drain hose 52 to the internal panel 30, sidewall, and/or the bottom wall of the electrical enclosure 12. In other embodiments, as shown in FIG. 12, the TE dehumidifier 10 can be positioned directly over the aperture 54. In one embodiment, a hook and loop fastener can be used to secure the TE dehumidifier in the position shown in FIG. 12.

Figure 13:
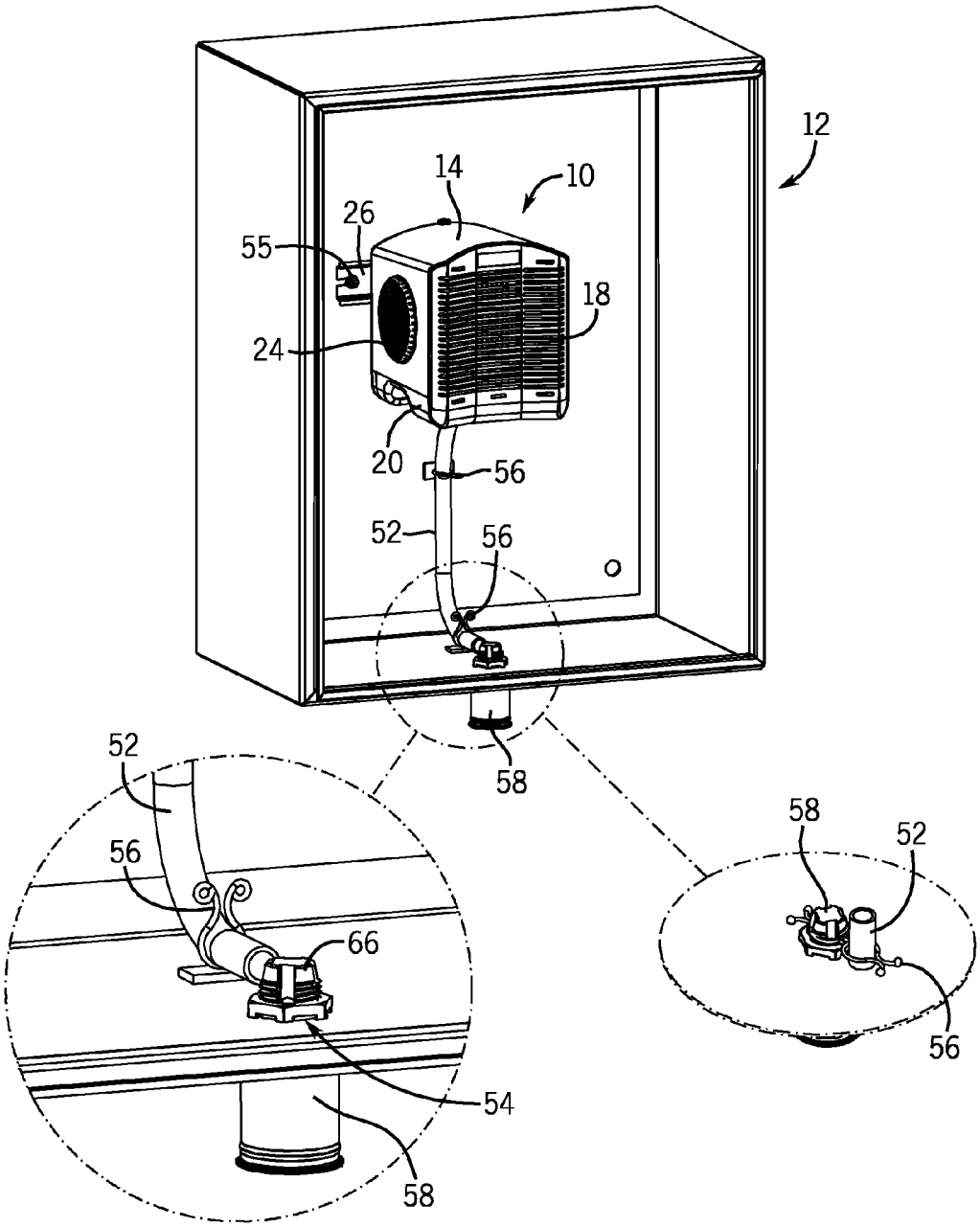
FIG. 13 is a perspective view of the TE dehumidifier of FIG. 1A and a vent drain assembly according to one embodiment of the invention.
Figure 14:
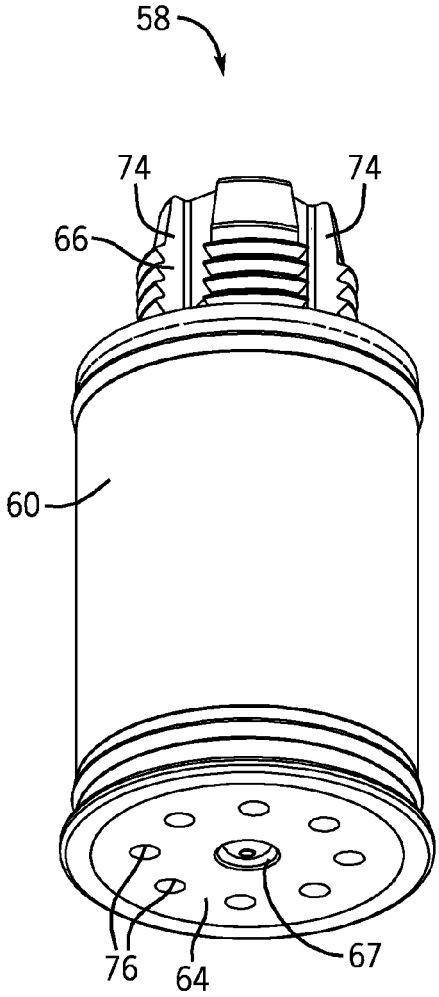
FIG. 14 is a perspective view of the vent drain assembly of FIG. 13.
Figure 15:
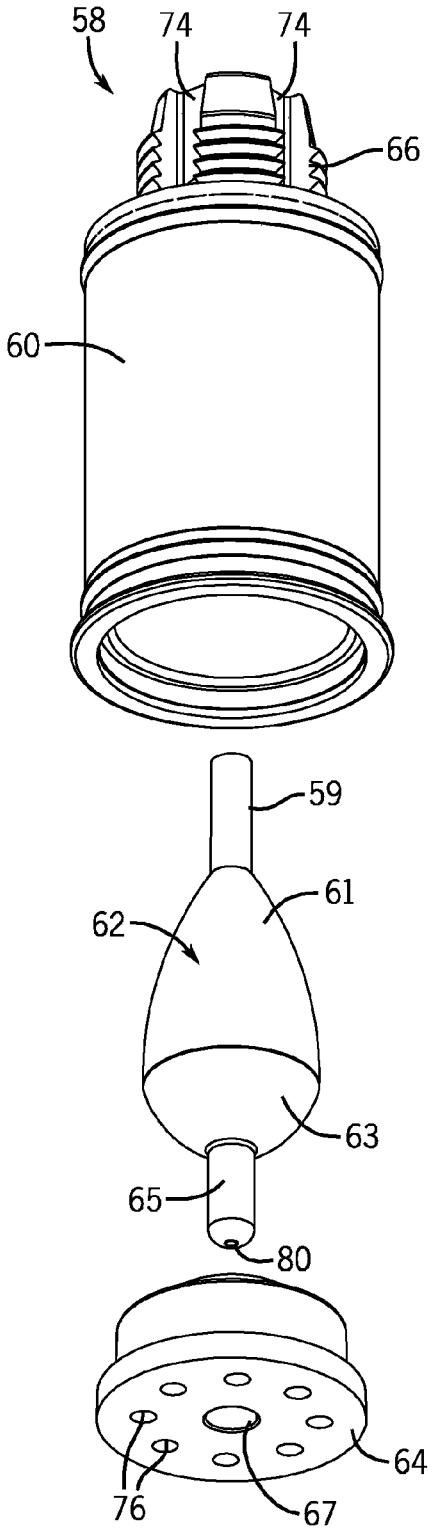
FIG. 15 is an exploded perspective view of the vent drain assembly of FIG. 13.
Figure 18:
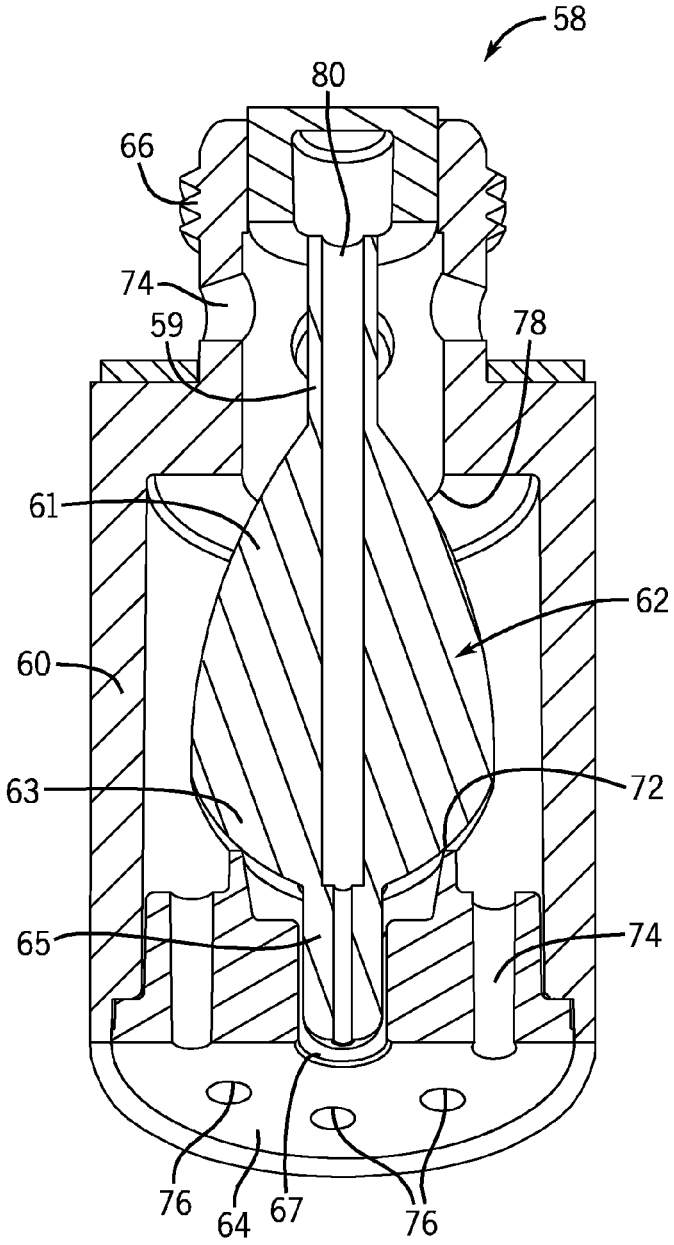
FIG. 18 is a cross-sectional view of the vent drain assembly of FIG. 13.

In some embodiments, as shown in FIGS. 1A-1B and 12-13, a vent drain assembly 58 can be installed in the aperture 54. The vent drain assembly 58 can permit excess moisture to leave the electrical enclosure 12, but can also prevent water and other contaminants from entering the electrical enclosure 12, while maintaining a normal pressure inside the electrical enclosure. FIGS. 14 and 15 illustrate the vent drain assembly 58 according to one embodiment of the invention. As shown in FIGS. 14 and 15, the vent drain assembly 58 can include a valve body 60, a float 62, and a cap 64. In some embodiments, the vent drain assembly 58 can be made of a non-metallic material (e.g., a corrosion-resistant polyester), stainless steel (e.g., type 304 stainless steel), and/or other suitable materials. In one embodiment, the float 62 can be made of a polypropylene material. In addition, the valve body 60 can have a threaded top end 66. The vent drain assembly 58 can be positioned in the aperture 54 so that the threaded top end 66 is inside the electrical enclosure 12, as shown in FIGS. 12 and 13. As shown in FIG. 15, the float can have an upper neck 59, an upper body 61, a lower body 63, and a lower neck 65. The upper neck 59 can extend into the threaded top end 66 of the valve housing 60, as shown in FIG. 18. The cap 64 can include a central hole 67 that encircles the lower neck 65, keeping the float 62 in a vertical configuration within the valve housing 60.

Figure 16A:
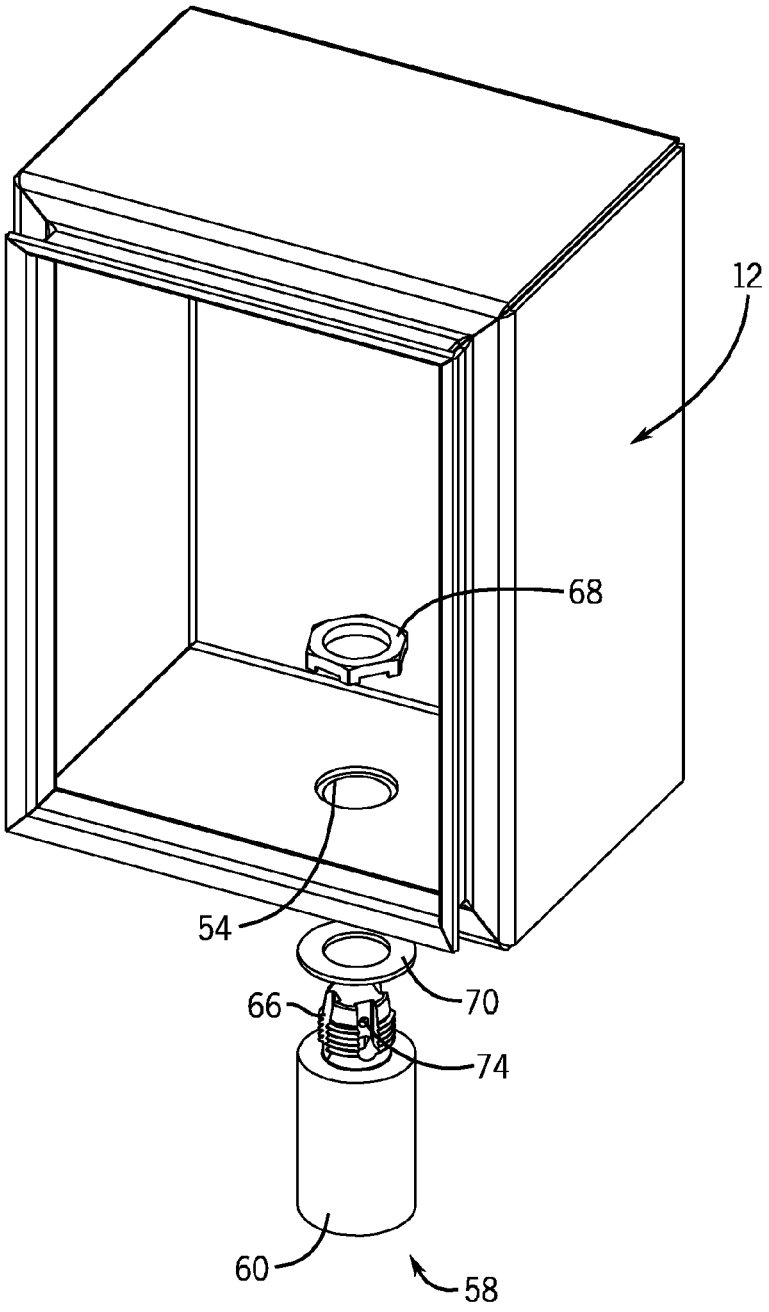
FIG. 16A is an exploded perspective view of the vent drain assembly of FIG. 13 positioned through an aperture of an electrical enclosure.
Figure 16B:
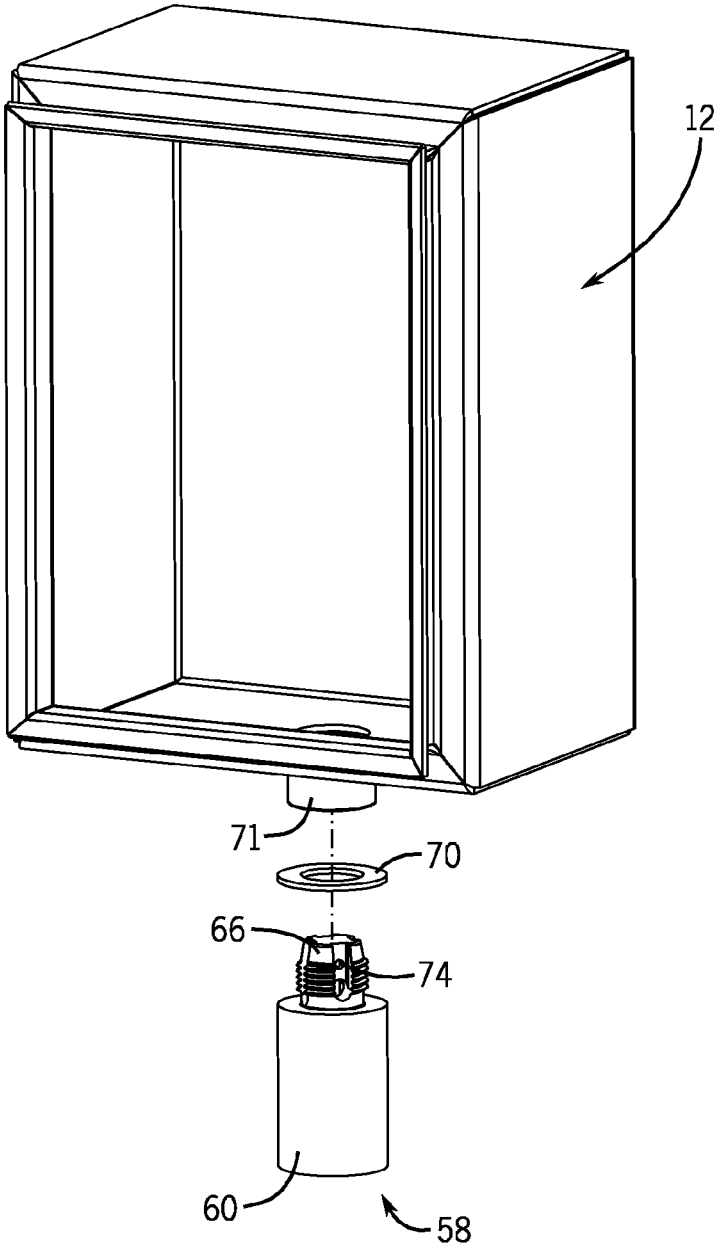
FIG. 16B is another exploded perspective view of the vent drain assembly of FIG. 13 positioned through an aperture of an electrical enclosure.

As shown in FIG. 16A, a slotted nut 68 and a gasket 70 can be used to secure the vent drain assembly 58 in the aperture 54. In some embodiments, as shown in FIG. 16B, a ½-inch threaded conduit hub 71 can be used to help secure the vent drain assembly 58 in the aperture 54. The threaded conduit hub 71 can have a standard National Pipe Thread (NPT) tapered thread of nominal pipe size (NPS) so that the threaded top end 66 can screw into it.

Figure 17A:
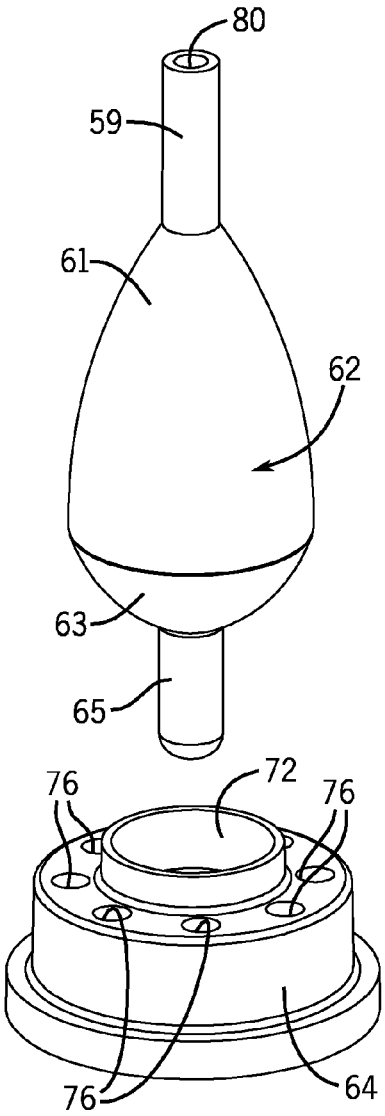
FIG. 17A is an exploded perspective view of a float and a cap of the vent drain assembly of FIG. 13.
Figure 17B:
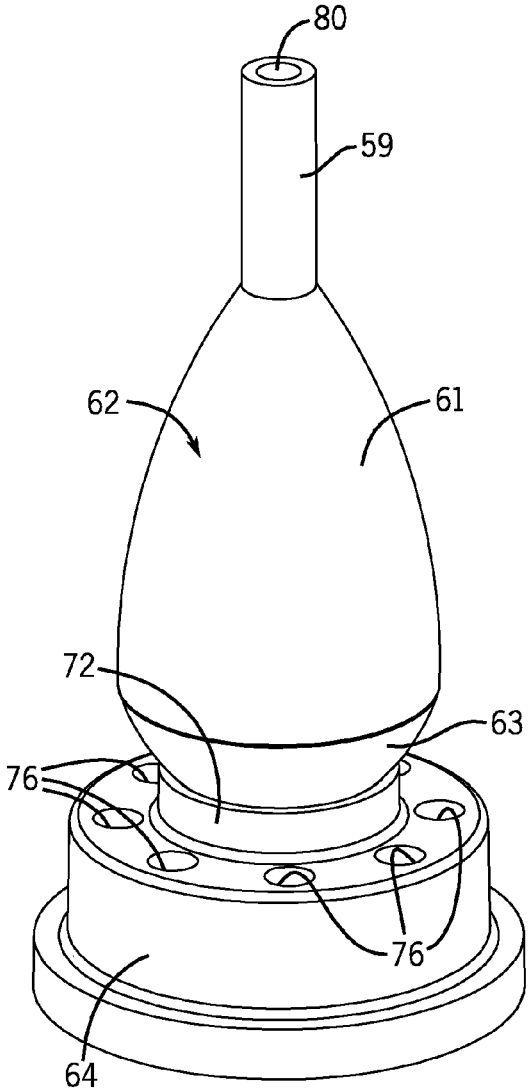
FIG. 17B is a perspective view of the float and the cap of FIG. 17A in a sealed position.

As shown in FIGS. 17A-17B, the cap 64 can include a drain seat 72. The lower body 63 of the float 62 can rest on the drain seat 72 when there is substantially no pressure difference between the inside and outside of the enclosure 12, as shown in FIG. 17B. In this position, the vent drain assembly 58 can allow an immediate fluid path from the inside of the enclosure 12 to the outside of the enclosure 12. More specifically, as shown in FIG. 18, the threaded top end 66 can include one or more holes 74 to allow condensation pooled at the bottom of the enclosure 12 to enter the vent drain assembly 58. Gravity can cause the condensate to flow down around the upper neck 59, upper body, 61, lower body 63, and/or lower neck 65 of the float 62 to the cap 64. Drain holes 76 in the cap 64 can allow the condensate to flow out the vent drain assembly 58 to the external environment.

Due to the vertical configuration of the vent drain assembly 58, an excess outside pressure would be needed to force water or contaminates up the drain holes 76 into the vent drain assembly 58. However, in the event that the pressure outside the enclosure 12 exceeds the pressure inside the enclosure 12, the float 62 can be forced (i.e., due to the excess pressure) to rise up until the upper body 61 reaches an inside shoulder 78 of the valve body 60 (as shown in FIG. 18). In this position, the float 62 can restrict the immediate fluid path between the inside of the enclosure 12 and the outside of the enclosure 12. Once the outside pressure decreases, gravity can again cause the float 62 to rest on the drain seat 72 and any condensate or contaminates in the vent drain assembly 58 can exit through the drain holes 76.

As shown in FIG. 18, the float 62 can also include a center pathway 80. The center pathway 80 can provide an alternate air path between the inside of the enclosure 12 and the outside of the enclosure 12. The center pathway 80 can have a small enough diameter to only allow air to travel through it. More specifically, the center pathway 80 can have a small enough diameter so that water vapor is too heavy to travel through it. For example, if water vapor enters the center pathway 80, it can condense and drip back out of the vent drain assembly 58.

During a hose-down or wash-down procedure of the exterior of the electrical enclosure 12, the pressure of the water being sprayed can cause the float 62 to rise up to the inside shoulder 78 of the valve body 60, cutting off the immediate fluid path and preventing water from entering the enclosure 12. In addition, during wash-down procedures, there is often a substantial temperature difference between the outside of the enclosure 12 and the inside of the enclosure 12. This can cause a pressure difference, where the lower pressure inside the enclosure 12 can act like a vacuum, holding the float 62 up against the inside shoulder 78. However, air can still travel through the center pathway 80 of the float 62 to equalize the pressure within the enclosure 12 and allow the float 62 to again drop onto the drain seat 72. As a result, the vent drain assembly 58 can be used, for example, in a NEMA type 4 or 4X electrical enclosure, while still meeting UL 508 standards.

Figure 19A:
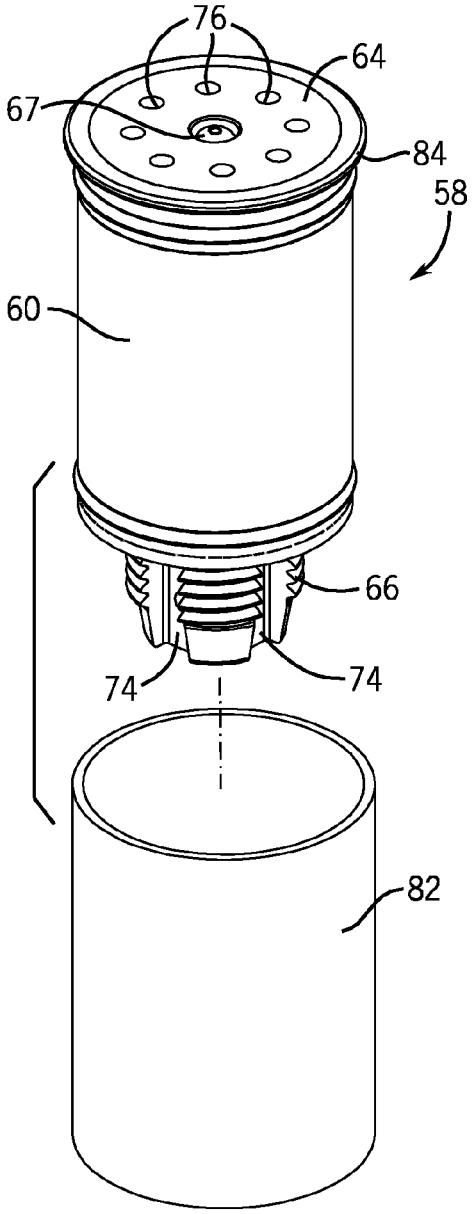
FIG. 19A is an exploded perspective view of the vent drain assembly of FIG. 13 and a sleeve according to one embodiment of the invention.
Figure 19B:
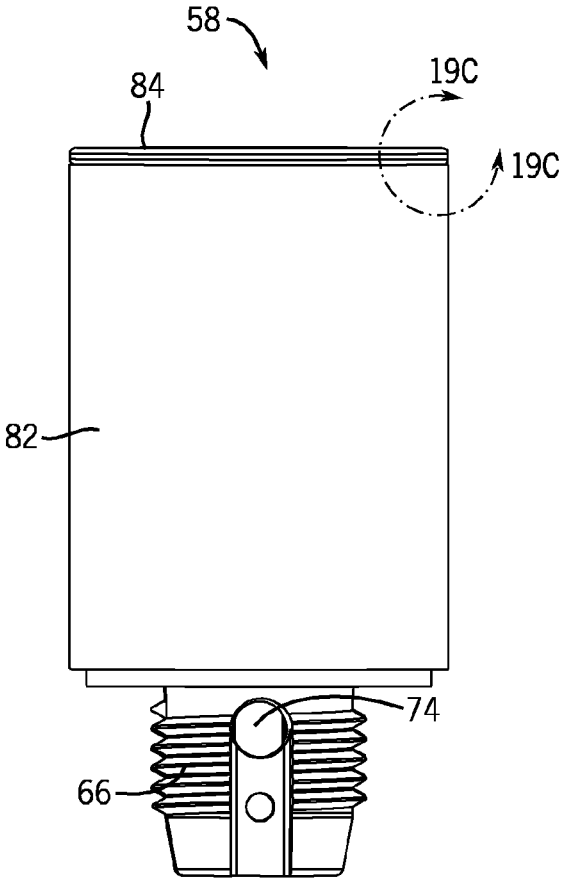
FIG. 19B is a side view of the vent drain assembly and sleeve of FIG. 19A.
Figure 19C:
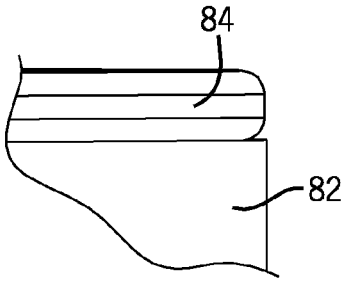
FIG. 19C is another side view of the vent drain assembly and sleeve of FIG. 19A.

In some embodiments, the vent drain assembly 58 can be about 2 inches long and about 1.25 inches in diameter. In addition, as shown in FIGS. 19A-19C, the vent drain assembly 58 can also include a sleeve 82 around the valve body 60. The sleeve 82 can be press fitted to a bottom flange 84 of the cap 64 and the threaded top end 66 can extend outside of the sleeve 82. The sleeve 82 can be made of, for example, type 304 stainless steel and can increase the diameter of the vent drain assembly 58 to about 1.38 inches in order to accommodate larger apertures 54.

Figure 20:
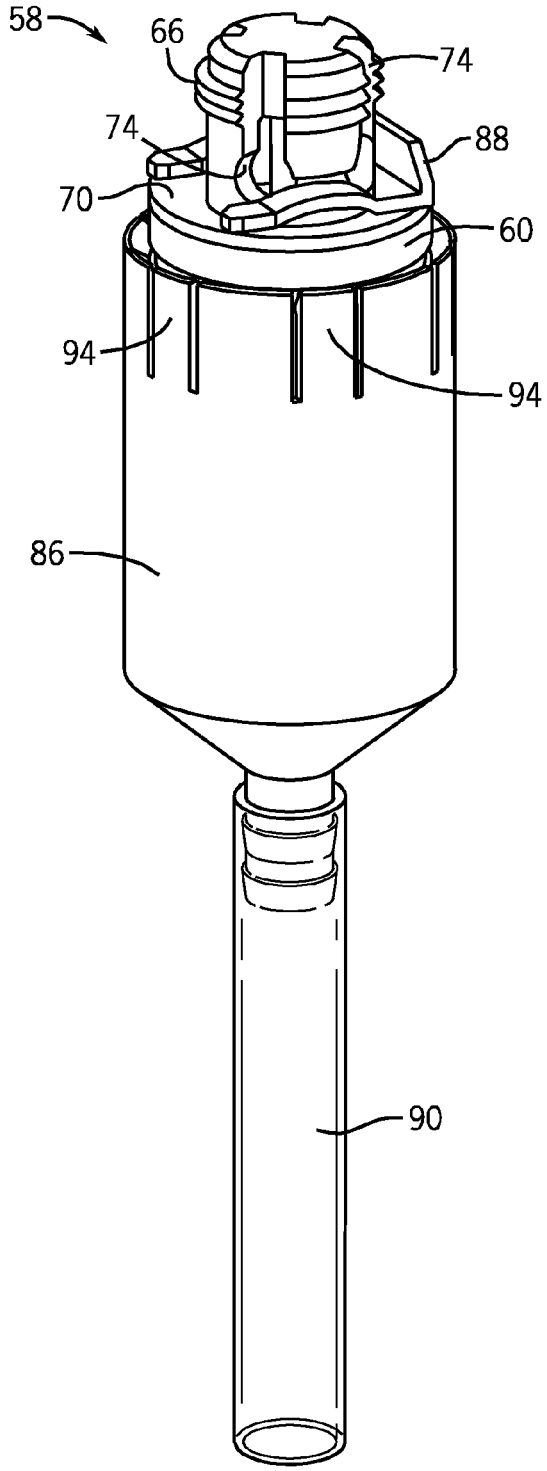
FIG. 20 is a perspective view of a vent drain assembly according to another embodiment of the invention.
Figure 21:
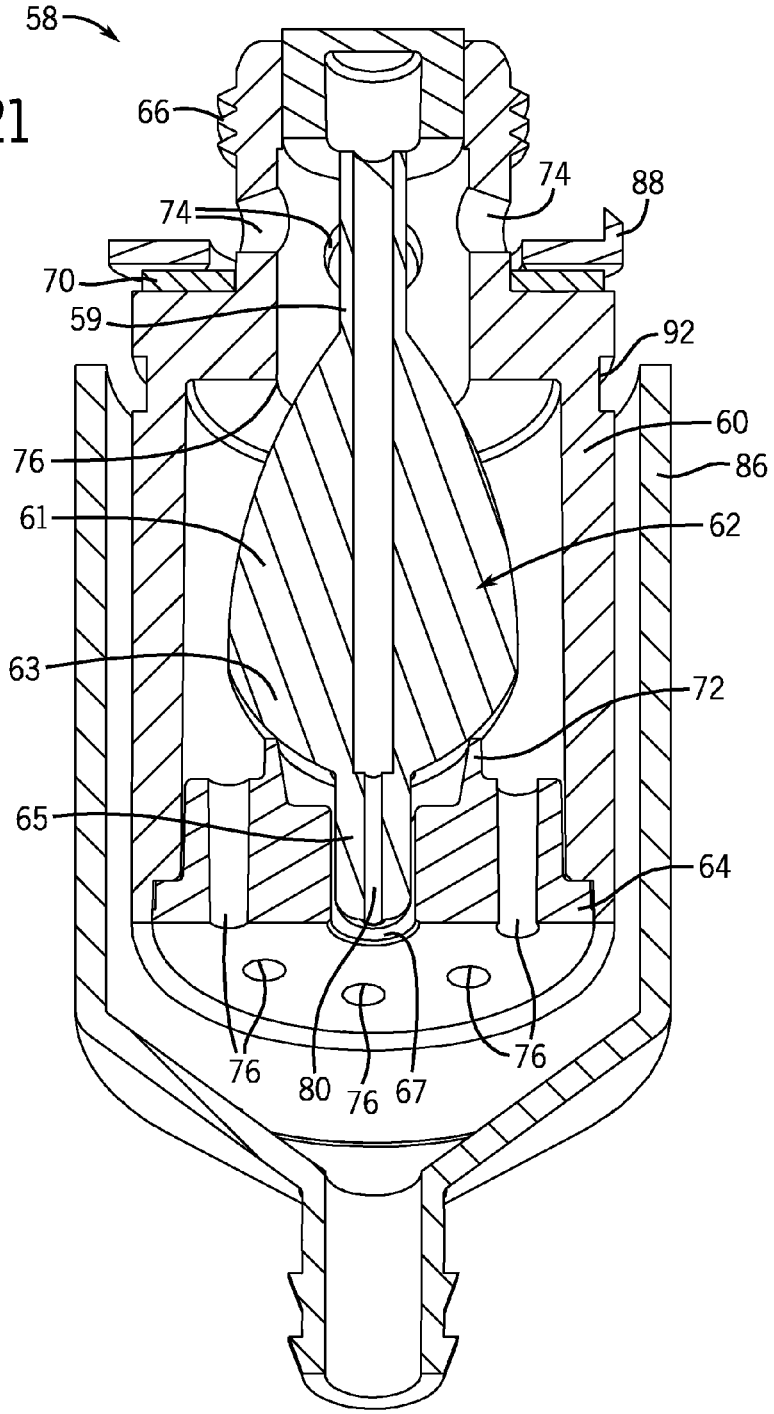
FIG. 21 is a cross-sectional view of the vent drain assembly of FIG. 20.
Figure 22:
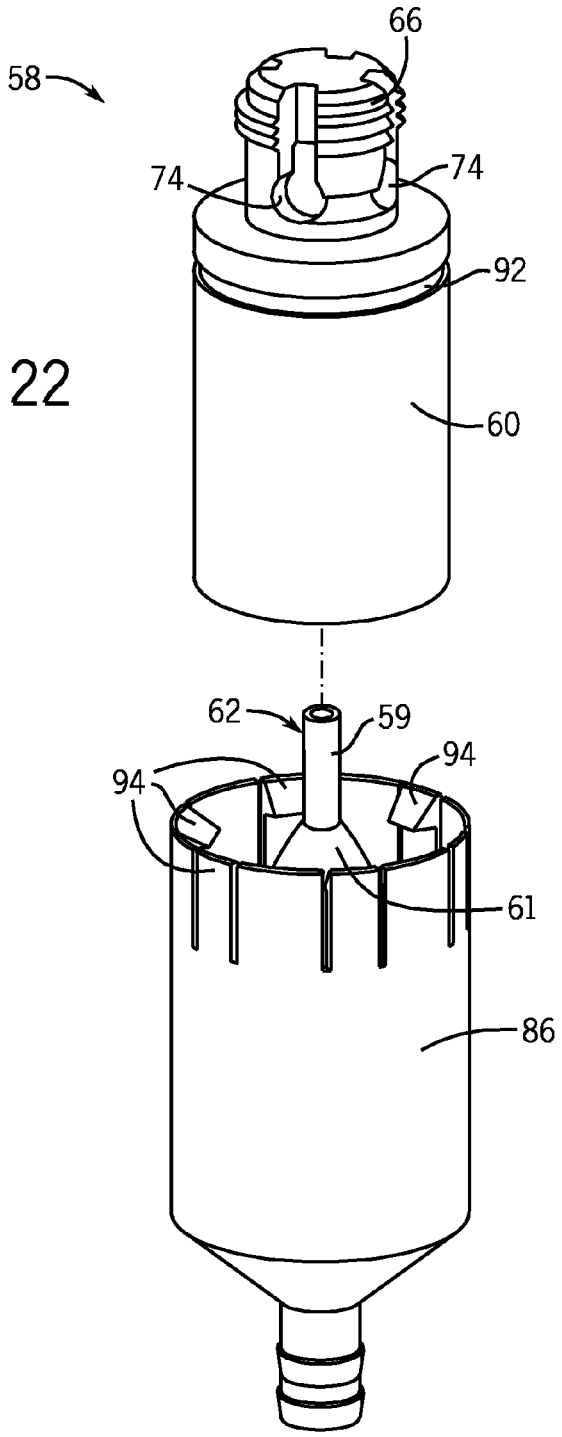
FIG. 22 is an exploded perspective view of the vent drain assembly of FIG. 20.

FIGS. 20-22 illustrate the vent drain assembly 58 according to another embodiment of the invention. The vent drain assembly 58 of FIGS. 20-22 can include the valve body 60, the float 62, the cap 64, the gasket 70, a valve housing 86, a clip 88, and a tube 90. The clip 88 can help secure the vent drain assembly 58 in the aperture 54. In one embodiment, the float 62 can be made of plastic and can be blow-molded. In some embodiments, as shown in FIGS. 21 and 22, the vent drain assembly 58 can be used without the tube 90 being attached.

As shown in FIGS. 21 and 22, the valve body 60 can have an outside notch 92 around its circumference near the threaded top end 66 and the valve housing 86 can have tabs 94. The valve body 60 can be pushed into the valve housing 86 until the tabs 94 snap into the outside notch 92 of the valve body 60.

Figure 23:
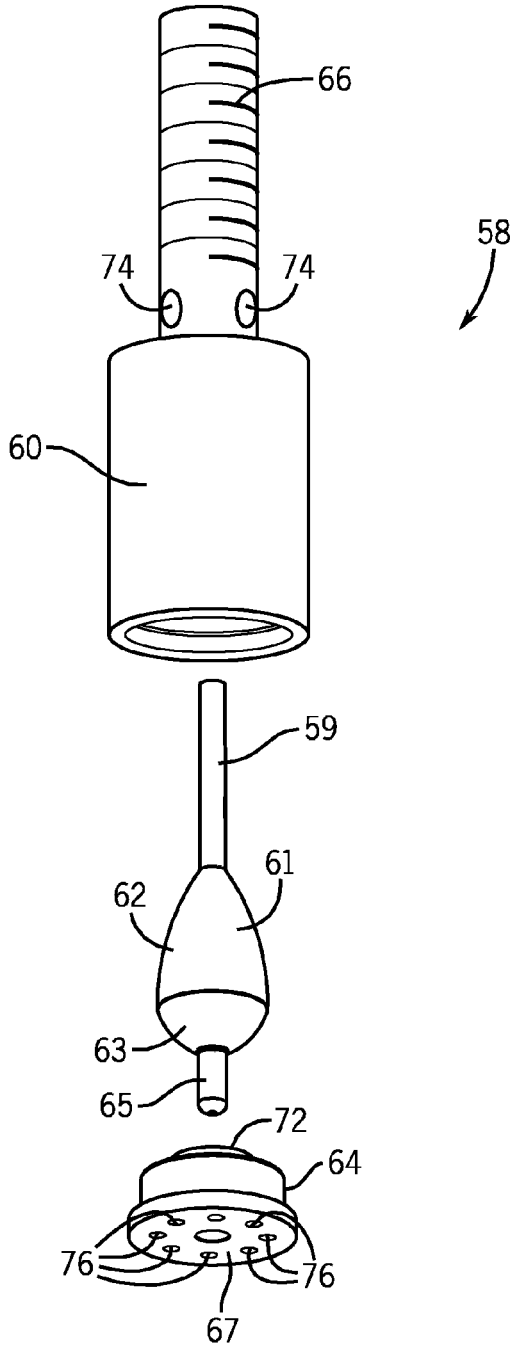
FIG. 23 is an exploded view of a vent drain assembly according to yet another embodiment of the invention.
Figure 24:
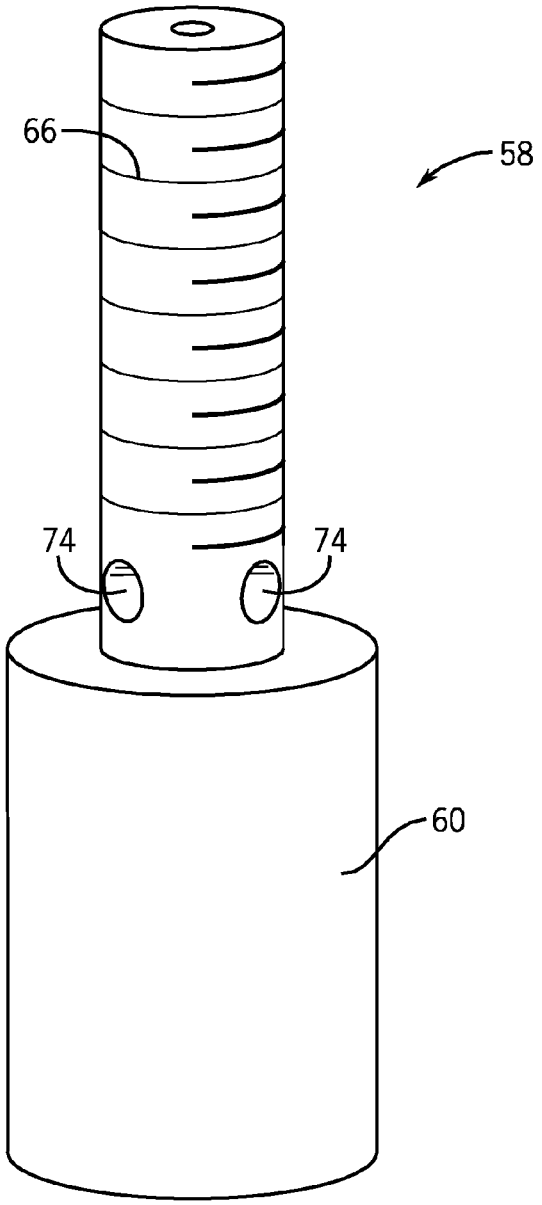
FIG. 24 is a perspective view of the vent drain assembly of FIG. 23.
Figure 25:
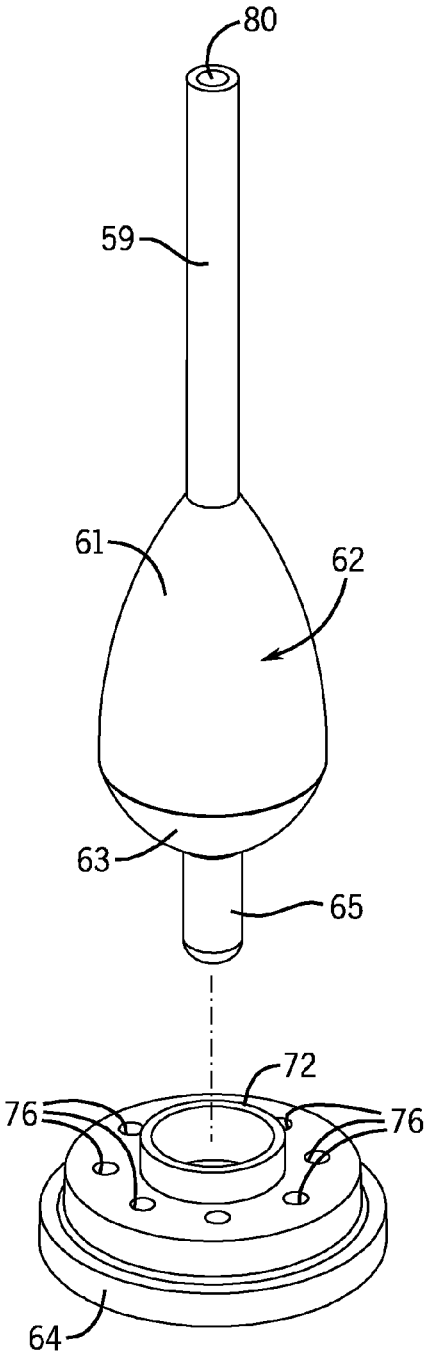
FIG. 25 is an exploded perspective view of a float and a cap of the vent drain assembly of FIG. 23.

FIGS. 23-25 illustrate the vent drain assembly 58 according to another embodiment of the invention. The vent drain assembly 58 of FIGS. 23-25 can include the valve housing 60, the float 62 with an extended upper neck 61, the cap 64, and an extended threaded top end 66. In some embodiments, the extended upper neck 61 can be provided in order to allow air to enter and exit the center pathway 80, an increased distance away from the drain holes 76 in the cap 64.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A system to reduce moisture in an electrical enclosure including an aperture, the system comprising:

a dehumidifier positioned in the electrical enclosure, the dehumidifier including a thermoelectric module, a drain pan to collect moisture from the thermoelectric module, and a fitting to release the collected moisture from the drain pan; and a vent drain assembly positioned in the aperture to receive the collected moisture from the drain pan and the fitting, the vent drain assembly including a valve body, a float, and a cap;

the float being movable between a first position abutting the valve body to prevent moisture from entering the electrical enclosure and a second position abutting the cap to allow moisture to exit the electrical enclosure;

the float including a center pathway sized to allow air to travel through into the electrical enclosure when the float is in the first position and the second position.

2. The system of claim 1 wherein the thermoelectric module includes two 12-volt thermoelectric chips connected in series.

3. The system of claim 1 and further comprising a hose coupled to the fitting to direct the collected moisture from the drain pan to the vent drain assembly.

4. The system of claim 1 wherein the center pathway has a diameter sized to allow air to travel into and out of the electrical enclosure and to prevent water vapor from traveling into the electrical enclosure.

5. The system of claim 1 wherein the dehumidifier includes a thermal switch configured to shut off the dehumidifier when condensing fins of the thermoelectric module are below a temperature setpoint.

6. The system of claim 1 wherein the dehumidifier is positioned directly over the aperture.

7. The system of claim 1 and further comprising mounting hardware for mounting the dehumidifier to a DIN rail.

8. The system of claim 7 wherein the mounting hardware includes a DIN clip.

9. A vent drain assembly to remove moisture from an electrical enclosure, the vent drain assembly comprising:

a valve body positioned inside the electrical enclosure, the valve body including a top portion with holes to receive moisture from the electrical enclosure, the valve body including a shoulder;

a cap coupled to the valve body and positioned outside the electrical enclosure, the cap including drain holes to allow moisture to exit the vent drain assembly, the cap including a drain seat; and a float movable between a first position contacting the shoulder of the valve body to prevent moisture from entering the electrical enclosure and a second position contacting the drain seat of the cap to allow moisture to exit the electrical enclosure;

the float including a center pathway sized to allow air to travel through into the electrical enclosure when the float is in the first position and the second position.

10. The vent drain assembly of claim 9 wherein the float is constructed of a polypropylene material.

11. The vent drain assembly of claim 9 and further comprising a nut and a gasket for securing the vent drain assembly to the electrical enclosure.

12. The vent drain assembly of claim 9 and further comprising a stainless steel sleeve positioned around the valve body.

13. The vent drain assembly of claim 9 wherein the center pathway allows air to flow in order to equalize pressures between outside the electrical enclosure and inside the electrical enclosure.

14. The vent drain assembly of claim 9 wherein the float is in the first position when a first pressure outside the electrical enclosure exceeds a second pressure inside the electrical enclosure.

15. The vent drain assembly of claim 9 wherein the float is in the second position at least one of when a first pressure inside the electrical enclosure exceeds a second pressure outside the electrical enclosure, when gravity forces the float against the drain seat, and when moisture in the electrical enclosure forces the float against the drain seat.

16. The vent drain assembly of claim 9 wherein the valve body and the cap are constructed of at least one of stainless steel and a corrosion-resistant polyester material.

17. A method of removing moisture from an electrical enclosure, the method comprising:

providing a vent drain assembly including a valve body and a cap enclosing a float;

the float moving to a first position against the valve body due to an excess pressure outside the electrical enclosure to prevent moisture from entering the electrical enclosure; the float moving to a second position against the cap to allow moisture in the electrical enclosure to enter the vent drain assembly one of when a first pressure inside the electrical enclosure exceeds a second pressure outside the electrical enclosure, when gravity forces the float against the cap, and when moisture in the electrical enclosure forces the float against the cap; and the float being removed from the first position when a vacuum is created inside the electrical enclosure by providing a center pathway in the float sized to allow air to travel through and equalize the first pressure with the second pressure, wherein air travels through the center pathway of the float in the first and second position.

18. The method of claim 17 and further comprising providing a thermoelectric dehumidifier for collecting moisture inside the electrical enclosure.

* * * * *